US007015920B2

(12) United States Patent
Ono

(10) Patent No.: US 7,015,920 B2
(45) Date of Patent: Mar. 21, 2006

(54) METHOD AND SYSTEM FOR PROVIDING USEABLE IMAGES ON A HIGH RESOLUTION DISPLAY WHEN A 2D GRAPHICS WINDOW IS UTILIZED WITH A 3D GRAPHICS WINDOW

(75) Inventor: Makoto Ono, San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 209 days.

(21) Appl. No.: 10/427,386

(22) Filed: Apr. 30, 2003

(65) Prior Publication Data

US 2004/0217964 A1 Nov. 4, 2004

(51) Int. Cl.
*G09G 5/36* (2006.01)

(52) U.S. Cl. ..... 345/545; 345/611

(58) Field of Classification Search ..... 345/501–503, 345/506, 531, 544, 545, 418, 419, 611, 613, 345/660, 661, 666, 694, 698, 699, 520, 532; 715/764, 810, 815; 382/254, 260, 266, 274, 382/293, 298, 299

See application file for complete search history.

(56) References Cited

U.S. PATENT DOCUMENTS

| | | | | |
|---|---|---|---|---|
| 4,684,936 | A | 8/1987 | Brown et al. | |
| 4,908,780 | A | 3/1990 | Priem et al. | |
| 5,287,438 | A * | 2/1994 | Kelleher | 345/613 |
| 5,317,689 | A | 5/1994 | Nack et al. | |
| 5,600,347 | A * | 2/1997 | Thompson et al. | 345/667 |
| 6,002,446 | A * | 12/1999 | Eglit | 348/581 |
| 6,014,125 | A * | 1/2000 | Herbert | 345/660 |
| 6,052,131 | A | 4/2000 | Oka | |
| 6,356,278 | B1 | 3/2002 | Stamm et al. | |
| 6,396,505 | B1 | 5/2002 | Lui et al. | |
| 6,496,160 | B1 | 12/2002 | Tanner et al. | |
| 6,532,018 | B1 * | 3/2003 | Chen et al. | 345/519 |
| 6,650,323 | B1 * | 11/2003 | Naegle et al. | 345/419 |
| 6,661,424 | B1 * | 12/2003 | Alcorn et al. | 345/611 |
| 6,704,034 | B1 * | 3/2004 | Rodriguez et al. | 715/860 |
| 6,756,978 | B1 * | 6/2004 | Chen et al. | 345/419 |
| 6,765,578 | B1 * | 7/2004 | Slavin | 345/472 |
| 6,774,912 | B1 * | 8/2004 | Ahmed et al. | 345/629 |
| 6,788,309 | B1 * | 9/2004 | Swan et al. | 345/629 |
| 6,828,983 | B1 * | 12/2004 | Vijayakumar et al. | 345/613 |
| 6,833,835 | B1 * | 12/2004 | van Vugt | 345/566 |
| 6,906,729 | B1 * | 6/2005 | Sanz-Pastor et al. | 345/611 |
| 2001/0020950 | A1 | 9/2001 | Shimizu et al. | |

(Continued)

*Primary Examiner*—Kee M. Tung
(74) *Attorney, Agent, or Firm*—Sawyer Law Group LLP

(57) ABSTRACT

A graphics pipeline for use with a high resolution display is disclosed. The graphics pipeline comprises a frame buffer configuration. The frame buffer configuration includes a first mode area and a second mode area. The graphics pipeline further includes a display pipeline for obtaining data from the frame buffer configuration. The display pipeline includes a controller. The controller provides pixels from the first mode area to the display as is. Finally, the controller expands pixels from the second mode area and provides the expanded pixels to the display. Accordingly, a system and method in accordance with the present invention solves the GUI problem (small icon and small menu text) of high resolution display by allowing the 3D Graphics Window to display fine pitch pictures while being able to display images in the 2D graphics window in a useable form. The system and method in accordance does not depend on the types of drawing objects (line or surface), drawing order, and crossover.

16 Claims, 9 Drawing Sheets

100

U.S. PATENT DOCUMENTS

2002/0063807 A1 5/2002 Margulis
2002/0070944 A1 6/2002 Deering
2002/0109687 A1 * 8/2002 Ishii et al. ..... 345/472.2
2004/0041817 A1 * 3/2004 Hunter ..... 345/611
2004/0090470 A1 * 5/2004 Kim et al. ..... 345/846

* cited by examiner

METHOD AND SYSTEM FOR PROVIDING USEABLE IMAGES ON A HIGH RESOLUTION DISPLAY WHEN A 2D GRAPHICS WINDOW IS UTILIZED WITH A 3D GRAPHICS WINDOW

FIELD OF THE INVENTION

The present invention relates generally to display technology and more particularly to providing useable images when 3D graphics windows are utilized with 2D graphics windows in a high resolution display.

BACKGROUND OF THE INVENTION

Based on the improvement of display resolution and display density, it is possible to render the detail of drawing objects in a 3D graphics window. Accordingly, a typical display resolution is 100 pixels per inch, however a high resolution display has a resolution as high as 200 pixels per inch. In so doing, it is possible to provide fine detail in images. For example, the detail of light reflection on high resolution display can be shown, which can avoid the illusion made by Gouraud shading. On the other hand, the usage of a high resolution display causes usability problems when the icons in the 2D graphics window are not properly scaled. To illustrate this problem in more detail refer now to FIG. 1. FIG. 1 illustrates a CAD application 10 in which the blueprint of a car 12 is shown in conjunction with a toolbar 14 on the display.

In this example, the user can access the detail of the blueprint of a car 12 in the 3D graphics window using the high-resolution display. On the other hand, the icon and text in the toolbar 14 is rendered too small to manipulate. This is because the software application is designed to be able to zoom and pan freely in the 3D graphics windows but the same software specifies the text height of the menu font by, pixel count in 2D graphics window. In so doing, the software makes the physical size of the fonts too small to be manipulated.

In order to resolve this problem, the software has to specify the size of objects, by physical dimension such as mm, not by pixel count. Microsoft Windows or OpenGL, which are Widely used today, do not specify the physical dimension. Accordingly, the design of the software would have to change to specify the all GUI related objects, which is not practical or cost effective solution.

Accordingly, what is needed is a system and method for allowing high-resolution display to provide both a 3D graphics window at its highest resolution while allowing icons or fonts on a 2D graphics window on the same display to be manipulatable without changing the design of standard software applications. The present invention addresses such a need.

SUMMARY OF THE INVENTION

A graphics pipeline for use with a high resolution display is disclosed. The graphics pipeline comprises a frame buffer configuration. The frame buffer configuration includes a first mode area and a second mode area. The graphics pipeline further includes a display pipeline for obtaining data from the frame buffer configuration. The display pipeline includes a controller. The controller provides pixels from the first mode area to the display as is. Finally, the controller expands pixels from the second mode area and provides the expanded pixels to the display.

Accordingly, a system and method in accordance with the present invention solves the GUI problem (small icon and small menu text) of high resolution display by allowing the 3D Graphics Window to display fine pitch pictures while being able to display images in the 2D graphics window in a useable form. The system and method in accordance with the present invention does not depend on the types of drawing objects (line or surface), drawing order, and crossover.

DETAILED DESCRIPTION

The present invention relates generally to display technology and more particularly to providing useable images when 3D graphics windows are utilized with 2D graphics windows in a high resolution display. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A system and method in accordance with the present invention takes advantage of the fact that application software uses one application programming interface (API) such as the OpenGL API in a 3D Graphics window while it uses a different API such as the Microsoft Windows API in a 2D Graphics windows to construct graphics user interface, such as menu and icon. In this case, each window's frame buffer configuration on a graphics card is different based on what graphics API the application uses. The present invention can be utilized advantageously using a super sample anti-aliasing (SSAA) graphics pipeline.

Figure 1:
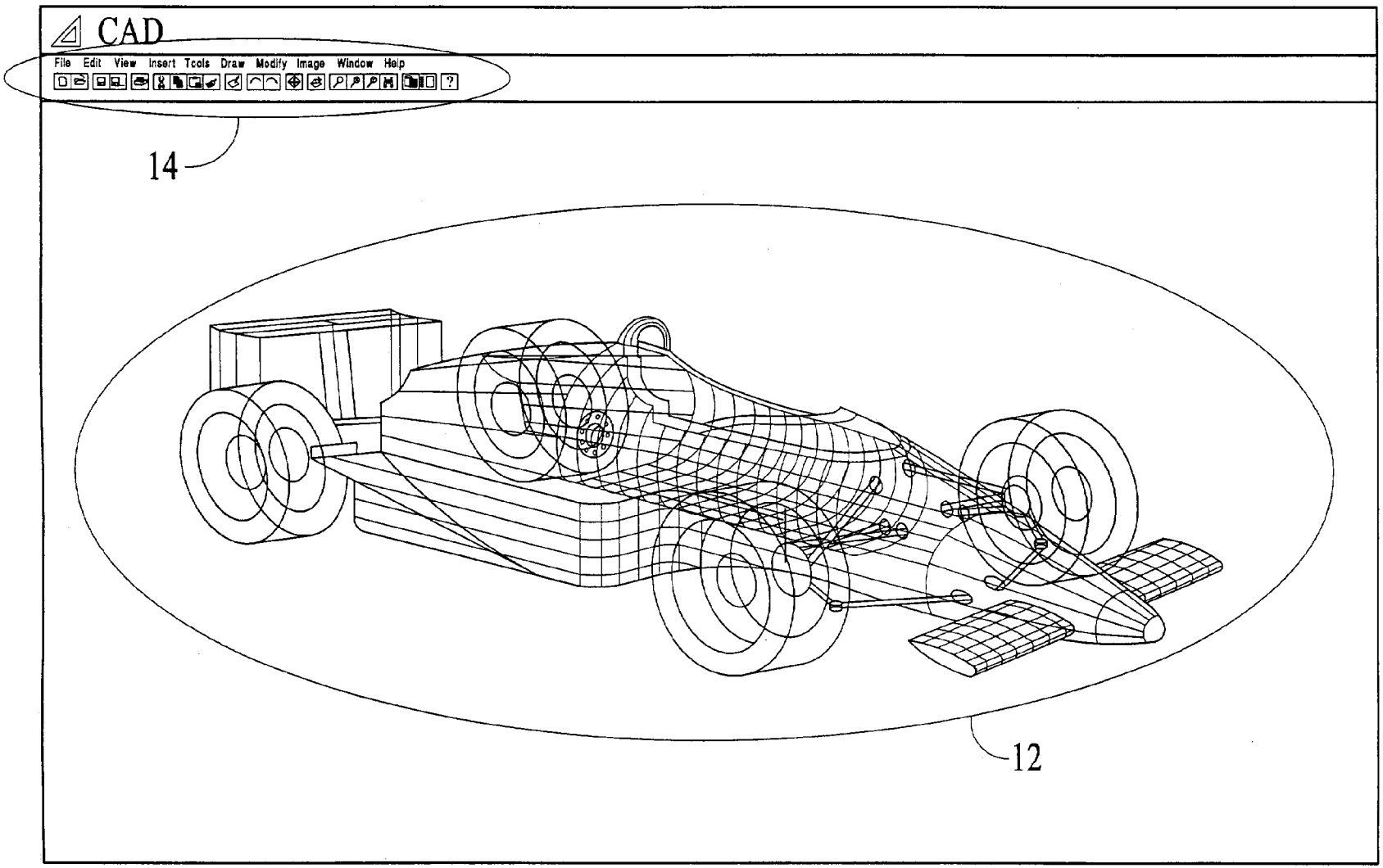
FIG. 1 illustrates a CAD application in which the blueprint of a car is shown in conjunction with a toolbar on the display.
Figure 2:
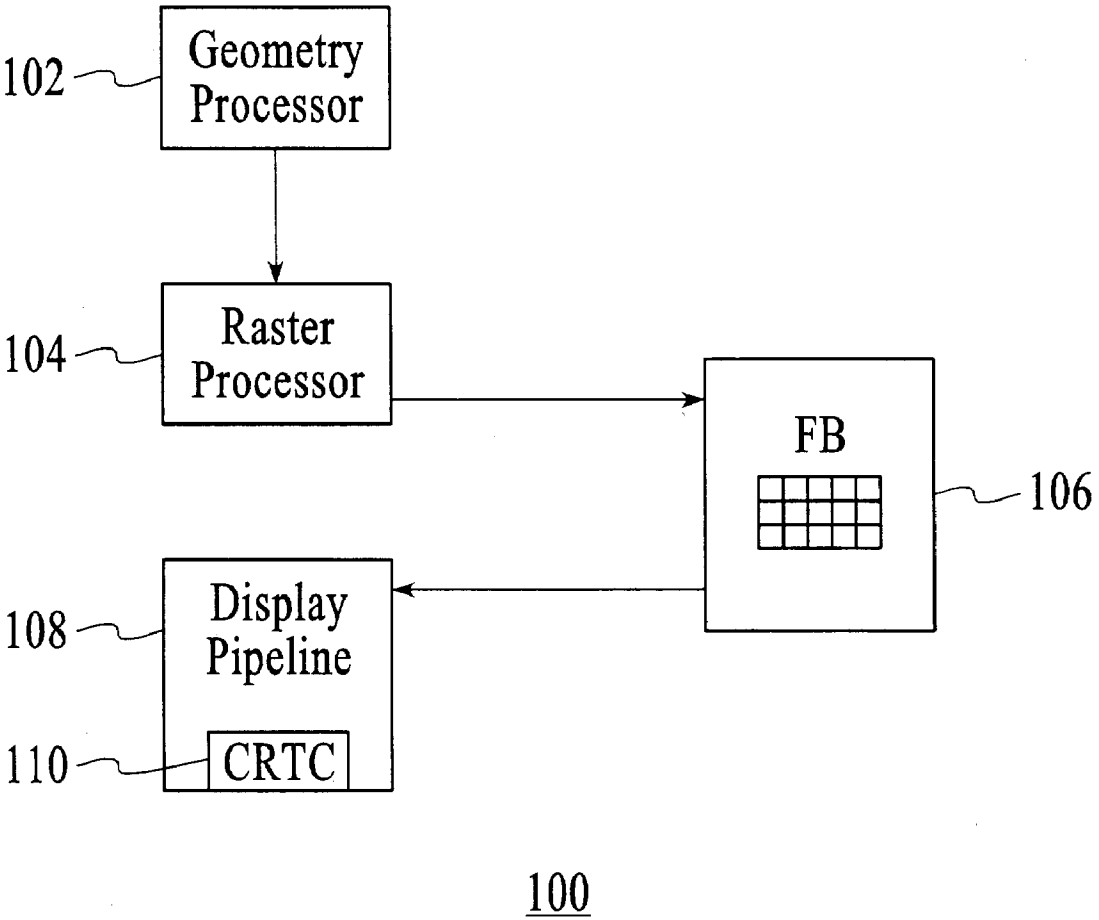
FIG. 2 is a typical super sample anti-aliasing (SSAA) graphics pipeline.

FIG. 2 is a typical SSAA graphics pipeline 100. The graphics pipeline 100 includes a geometry processor 102, which receives the data and passes it to a raster processor 104. The geometry processor 102 and the raster processor 104 create a frame buffer 106, which stores the data. A display pipeline 108 retrieves the contents of the frame buffer 106. The contents are then handled by a cathode ray tube controller (CRTC) 110 within the display pipeline 108. In a super sampling mode, a non-super-sampled pixel is provided as is, and a super-sampled pixel is provided as an averaged pixel. The display CRTC 110 is set at a low resolution when in the super sampling mode.

Figure 3:
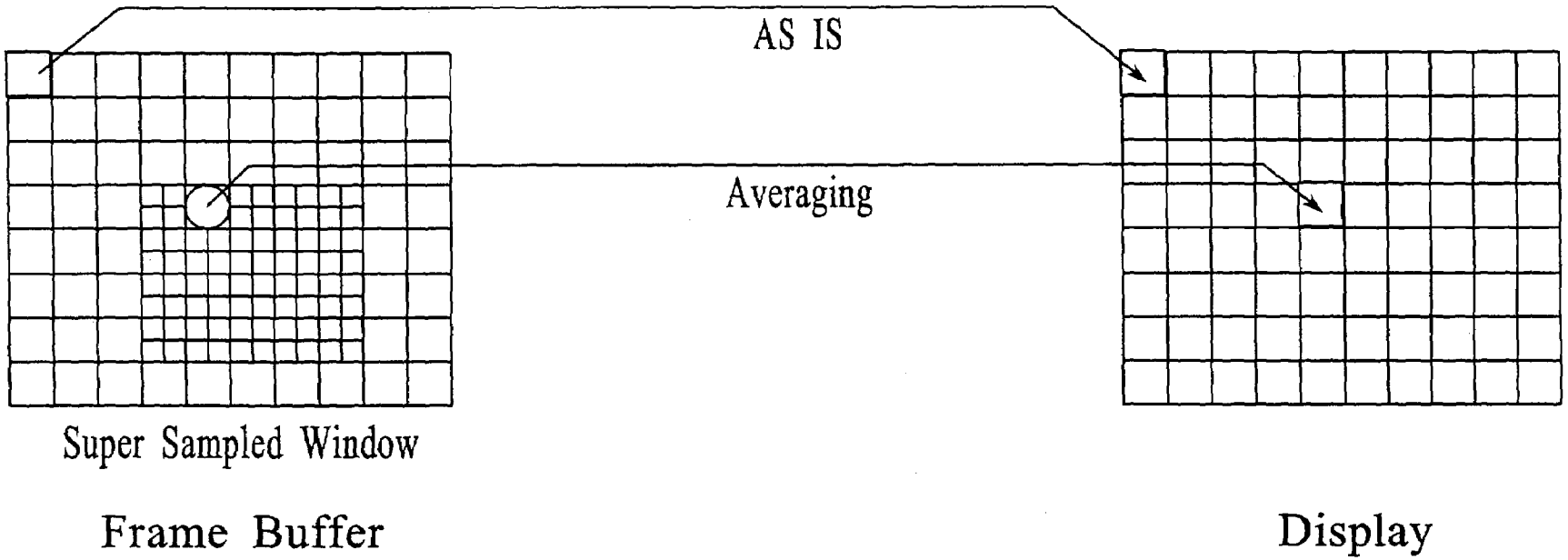
FIG. 3 illustrates the conventional purpose of super sampling an image.

FIG. 3 illustrates the conventional purpose of super sampling an image. As is seen the purpose is to offer multipurpose anti-aliasing in a super sampled window. Accordingly, pixels that are outside the super sampled window are provided as is from the frame buffer to the display while pixels from the super sampled window are averaged when provided to the display.

Figure 4:
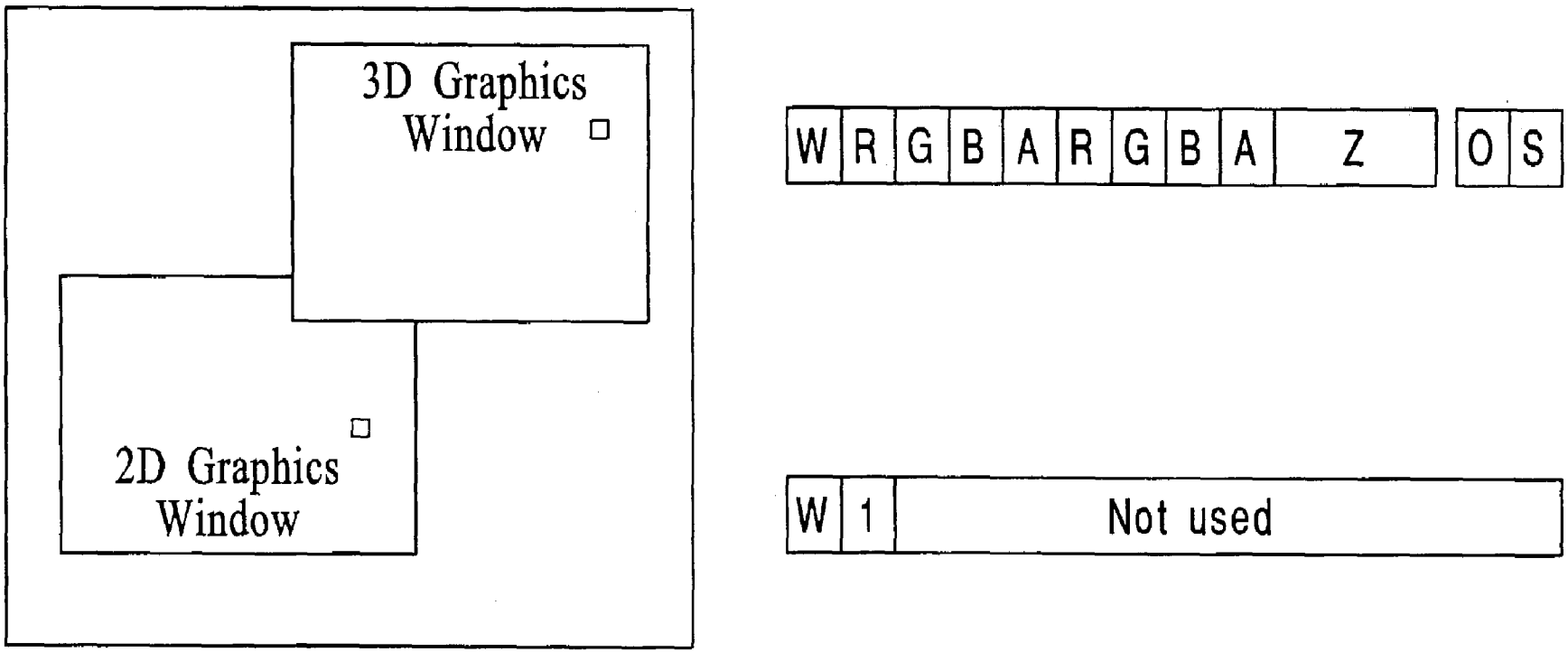
FIG. 4 illustrates a typical pixel format in a frame buffer utilized in the graphics pipeline.

FIG. 4 illustrates a typical pixel format in a frame buffer 106 utilized in the graphics pipeline 100. As is seen, this figure shows that there are many information fields including Z (depth) information to perform "hidden line/hidden surface removal" as well as simple color information field in a single pixel on a 3D graphics window. On the other hand, the system allocates simple color information only in a single pixel on a 2D graphics window. In order to identify the difference of the type of the pixel, usually the system allocates a Window ID field for every pixel regardless of the pixel type.

SSAA has become widely available on high end graphics cards. This technology (1) prepares multiple sub pixels for a single displayable pixel in a frame buffer and draws objects for the subpixels, and (2) lets CRTC scan the frame buffer and displays a non SSAA pixel as it was but displays averaged sub pixel values for a SSAA pixel.

In a system and method in accordance with the present invention SSAA is utilized in different manner. Therefore a system and method in accordance with the present invention (1) allocates multiple subpixels in a single pixel on a 3D graphics window (2) expands (to zoom) the color information of 2D graphics Window pixel when the CRTC creates its images, and (3) displays the color information of 3D graphics window subpixel as is.

Accordingly, a system and method in accordance with the present invention solves the GUI problem (small icon and small menu text) of high resolution display by allowing the 3D graphics window to display fine pitch pictures while being able to display images in the 2D graphics window in a useable form. The system and method in accordance does not depend on the types of drawing objects (line or surface), drawing order, and crossover.

Figure 5:
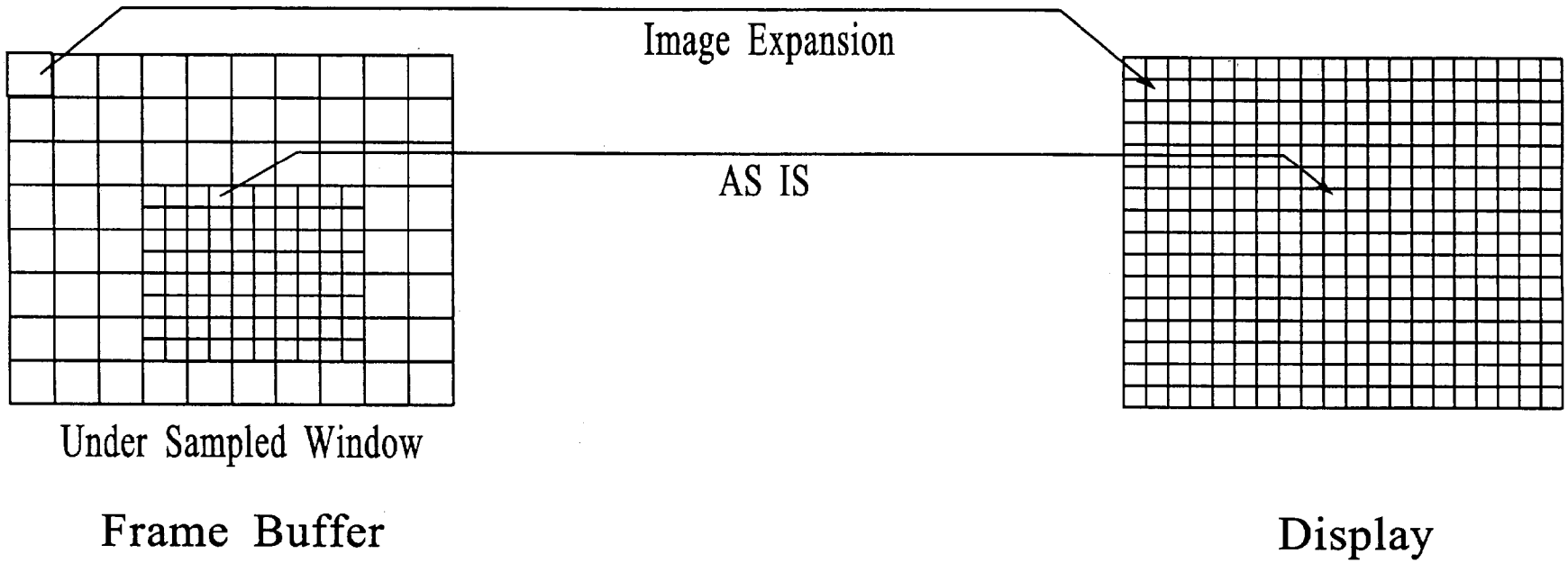
FIG. 5 illustrates utilizing a SSAA frame buffer configuration for a high-resolution display in accordance with the present invention.

FIG. 5 illustrates utilizing SSAA frame buffer configuration for a high-resolution display in accordance with the present invention. Rather than having a super sampled area in the frame buffer there is an under sampled area. The under sampled area corresponds to the 3D graphics window. The non under sampled area corresponds to the 2D graphics window. As is seen the pixels in the under sampled window (i.e. the 3D graphics window) will be provided as is to the display while the pixels from non under sampled window (i.e. the 2D graphics window) will be expanded.

Figure 6:
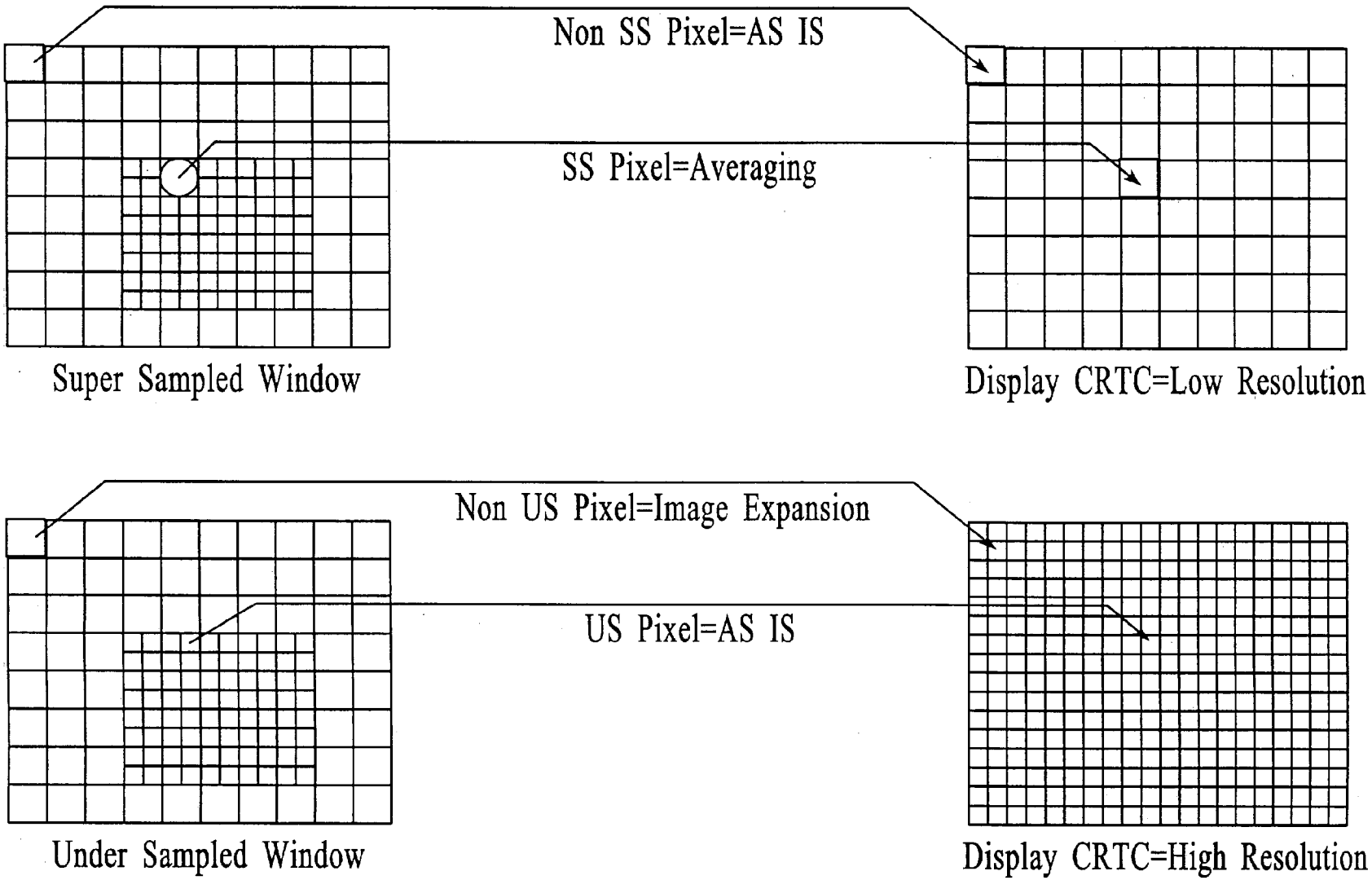
FIG. 6 shows clearly the differences between a conventional super sampling frame buffer configuration versus the under sampling frame buffer configuration in accordance with the present invention.

In a preferred embodiment, the graphics pipeline will program the CRTC to configure a subpixel count resolution. The CRTC will also be programmed to display the subpixels as is. The CRTC will display the 2D graphics in expanded form at a ratio of subpixels per pixel (in case of 4 subpixels per single pixel, the pixel will be expanded as ×2 (width) and ×2 (height). FIG. 6 shows clearly the differences between the conventional super sampling frame buffer configuration versus the under sampling frame buffer configuration in accordance with the present invention.

The following sections will describe a detailed implementation of a system and method in accordance with the present invention, however, the present invention is not restricted to this implementation and other implementations could be utilized and they would be within the spirit and scope of the present invention.

Figure 7:
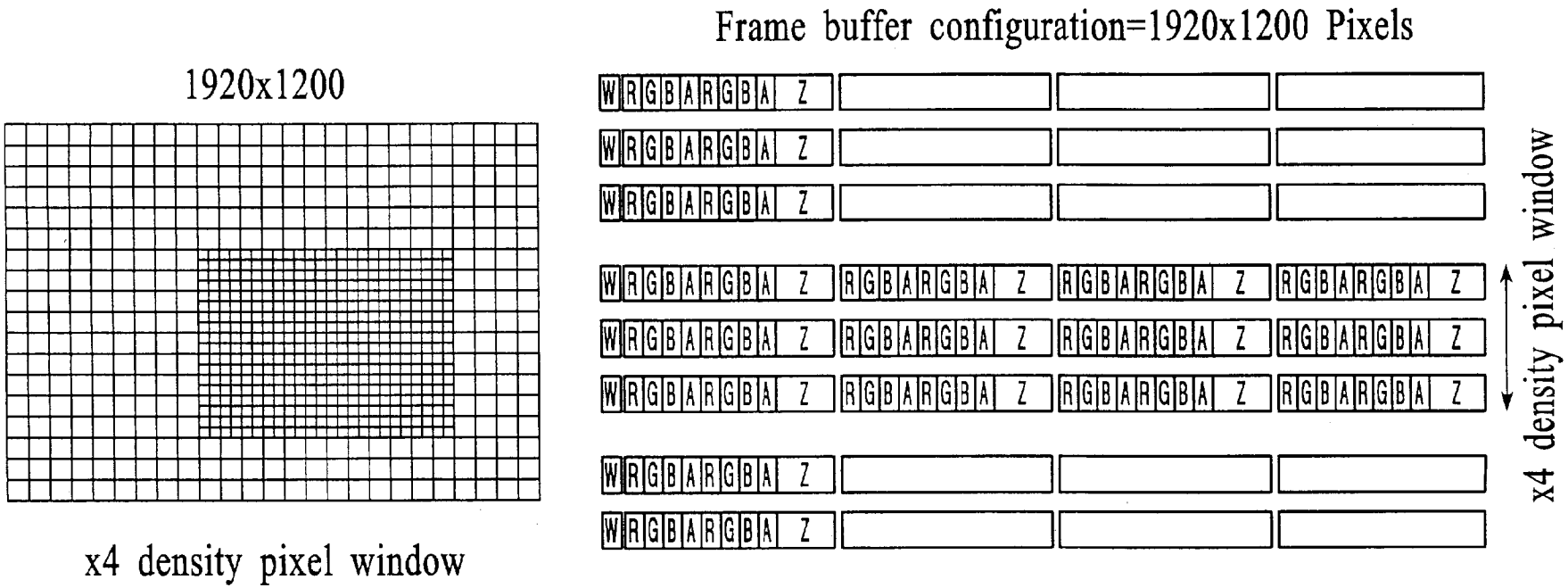
FIG. 7 illustrates a frame buffer implementation configuration in accordance with the present invention.

FIG. 7 illustrates the frame buffer configuration in accordance with the present invention. In this implementation the pixel resolution is 1920×1200 and the subpixel in 3D Graphics windows is configured as a 2×2 utilizing SSAA frame buffer configuration.

Figure 8:
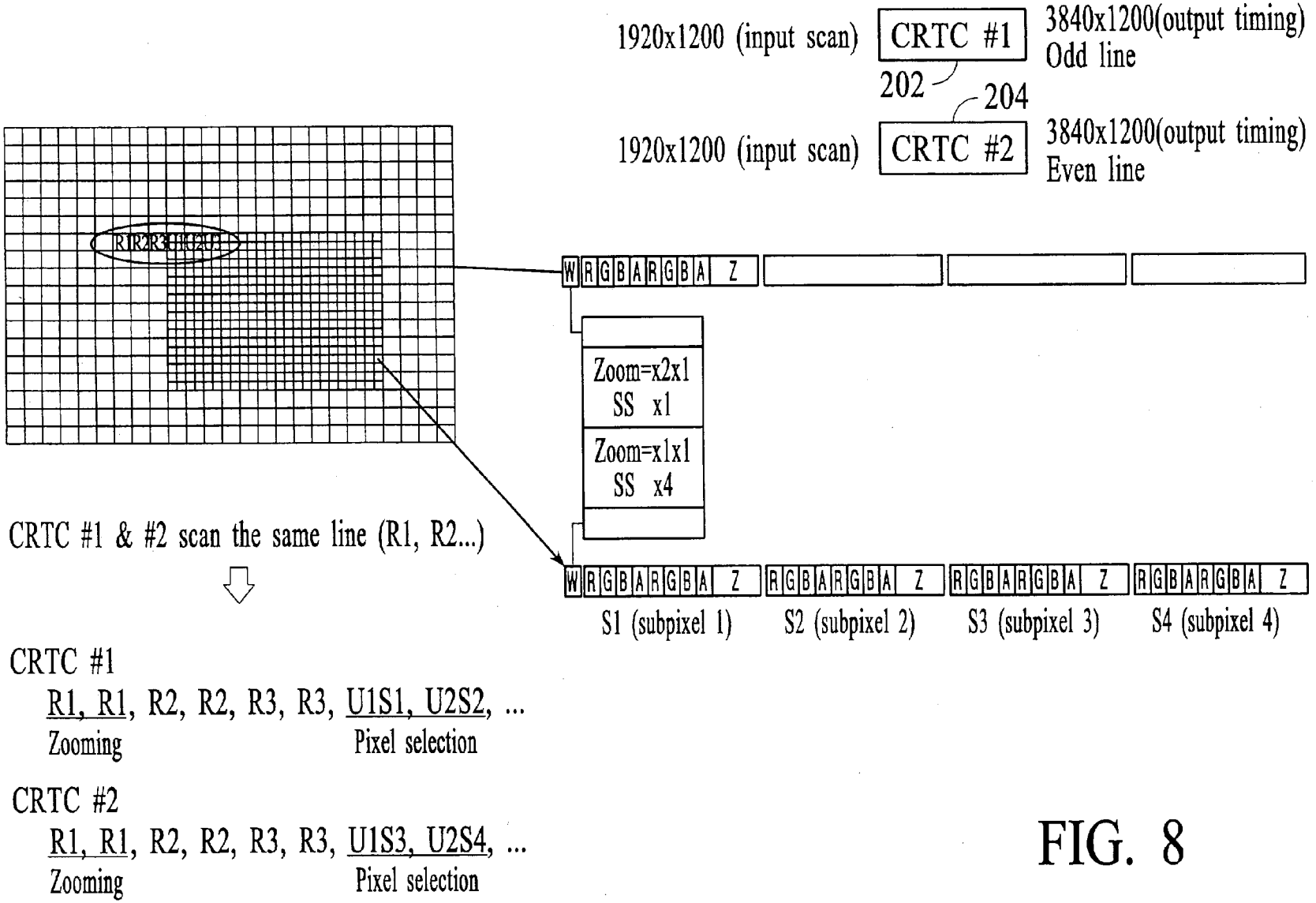
FIG. 8 illustrates scanning the frame buffer configuration by first and second CRTCs within the display pipeline.

FIG. 8 illustrates scanning the frame buffer configuration by first and second CRTCs 202 and 204 within the display pipeline. This implementation assumes even/odd type two-channel scan such as DualLink DVI. Each CRTC 202 and 204 will retrieve and display even line or odd line. Both CRTCs 202 and 204 are programmed to scan the same frame buffer (both CRTCs 202 and 204 will scan 1920×1200 pixels simultaneously), and display 3840×1200 signals (subpixel count/2 due to split for even and odd).

Now, first consider the case scanning the pixels of R1, R2, R3, U1 U2, U3. R1, R2, R3 indicate the pixels that are configured as being within the 2D graphics window and U1, U2, U3 indicate the pixels that are configured as being within the 3D graphics window. A set zoom factor is set as 2×1 (twice in width, as it is for height) for R1, R2, R3 pixel utilizing a conventional zoom and pan function of graphics card. When a CRTC scans pixels R1, R2, R3, it will generate the display signal as R1 R1, R2, R2, R3, and R3. Now, since two CRTCs 202 and 204 now scan the same frame buffer, R1, R2, R3 pixels in the frame buffer will create display signals as:

R1, R1, R2, R2, R3, R3 (odd line)

R1, R1, R2, R2, R3, R3 (even line) that is 2×2 expanded image.

On the other hand, in order to scan pixels in 3D Graphics window, a subpixel is selected from a pixel instead of averaging subpixels (subpixel selector).

The odd line CRTC 202 is programmed to select and to display the first subpixel and the second subpixel, and the even line CRTC 204 is also programmed to select and to display the third subpixel and the fourth subpixel Then, when odd line CRTC 202 scans U1, U2, U3, it will display U1-S1, U1-S2, U2-S1, U2-S2, U3-S1, U3-S2 and when even line CRTC 204 scans U1, U2, U3, it will display U1-S3, U1-S4, U2-S3, U2-S4, U3-S3, and U3-S4. The programming can be performed in a variety of ways and they would be within the spirit and scope of the present invention.

Figure 9:
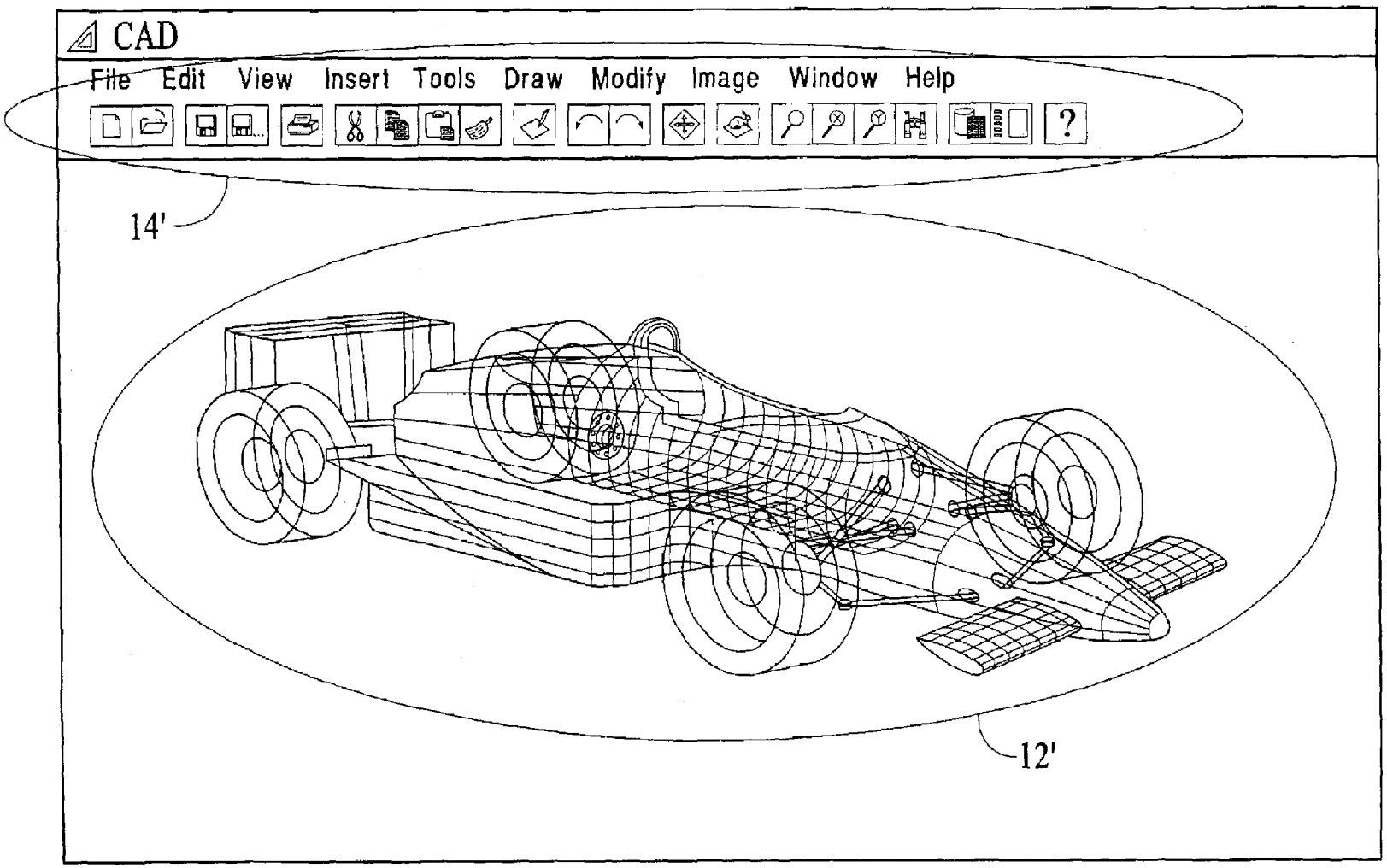
FIG. 9 illustrates the results of the present invention.

FIG. 9 illustrates the results in accordance with the present invention. As is seen, the icons 14' are now at a size which are useable by the operator while still maintaining the resolution of the blueprint of the car 12'.

Accordingly, a system and method in accordance with the present invention solves the GUI problem (small icon and small menu text) of high resolution display by allowing the 3D graphics window to display fine pitch pictures while being able to display images in the 2D graphics window in a useable form. The system and method in accordance does not depend on the types of drawing objects (line or surface), drawing order, and crossover.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A graphics pipeline for use with a high resolution display comprising:

a frame buffer configuration, the frame buffer configuration including a first mode area and a second mode area; and a display pipeline for obtaining data from the frame buffer configuration, the display pipeline including a controller, the controller for providing pixels from the first mode area to the display as is and the controller for expanding pixels from the second mode area and providing the expanded pixels to the display, wherein the first mode area comprises an under sampled area that corresponds to a 3D graphics window, and the second mode area comprises a non under sampled area that corresponds to a 2D graphics window on the display.

2. The graphics pipeline of claim 1, wherein the controller comprises a cathode ray rube controller (CRTC) mechanism.

3. The graphics pipeline of claim 2, wherein the CRTC mechanism comprises first and second CRTCs.

4. The graphics pipeline of claim 1, wherein the frame buffer configuration comprise a Super Sample Anti Aliasing (SSAA) frame buffer configuration.

5. The graphics pipeline of claim 1, wherein the expanded pixels provide a 2×2 expanded image.

6. The graphics pipeline of claim 1, wherein the high resolution display comprises a 1920×1200 pixel resolution.

7. A display pipeline comprising:

a controller for receiving pixels information from a super sample anti aliasing (SSAA) frame buffer configuration, the controller having a first mode and second mode, the first mode for allowing the controller to operate in a super sampling mode and the second mode for allowing the controller to operate in an under sampling model, wherein in the under sampling mode the controller provides pixels from an under sampled area in the frame buffer configuration to the high resolution display as is and expands the pixels from a non under sampled area in the frame buffer configuration and provides the expanded pixels to the display, and wherein the under sampled area corresponds to 3D graphics window on the display and the non under sampled area corresponds to a 2D graphics window on the display.

8. The display pipeline of claim 7, wherein the under sampling mode is utilized with a high resolution display.

9. The display pipeline of claim 8, wherein the controller comprises a cathode ray tube controller (CRTC) mechanism.

10. The display pipeline of claim 9, wherein the CRTC mechanism comprises first and second CRTCs.

11. A graphics card comprising:

a geometry processor, a raster processor for receiving data from the geometry processor;

a frame buffer configuration for receiving data from the raster processor, the frame buffer configuration including a first mode area and a second mode area; and a display pipeline for obtaining data from the frame buffer configuration, the display pipeline including a controller, the controller for providing pixels from the first mode area to the display as is and the controller for expanding pixels from the second mode area and providing the expanded pixels to the display, wherein the first mode area comprises an under sampled area that corresponds to a 3D graphics window, and the second mode area comprises a non under sampled area that corresponds to a 2D graphics window on the display.

12. The graphics card of claim 11, wherein the controller comprises a cathode ray tube controller (CRTC) mechanism.

13. The graphics card of claim 12, wherein the CRTC mechanism comprises first and second CRTCs.

14. The graphics card of claim 11, wherein the frame buffer configuration comprise a Super Sample Anti Aliasing (SSAA) frame buffer configuration.

15. The graphics card of claim 11, wherein the expanded pixels provide a 2×2 expanded image.

16. The graphics card of claim 11, wherein the high resolution display comprises a 1920×1200 pixel resolution.

* * * * *

UNITED STATES PATENT AND TRADEMARK OFFICE

CERTIFICATE OF CORRECTION

PATENT NO. : 7,015,920 B2
APPLICATION NO. : 10/427386
DATED : March 21, 2006
INVENTOR(S) : Makoto Ono It is certified that error appears in the above-identified patent and that said Letters Patent is hereby corrected as shown below:

Column 1

Line 44: delete "Widely" and Replace with --widely--.

Column 5

Line 19: delete "rube" and replace with --tube--.

Signed and Sealed this

First Day of August, 2006

JON W. DUDAS
*Director of the United States Patent and Trademark Office*